US007225635B2

(12) United States Patent
Matsumoto et al.

(10) Patent No.: US 7,225,635 B2
(45) Date of Patent: Jun. 5, 2007

(54) REFRIGERANT CYCLE APPARATUS

(75) Inventors: Kenzo Matsumoto, Gunma-ken (JP); Haruhisa Yamasaki, Gunma-ken (JP); Masaji Yamanaka, Tatcbayashi (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 136 days.

(21) Appl. No.: 11/053,901

(22) Filed: Feb. 10, 2005

(65) Prior Publication Data

US 2005/0178151 A1 Aug. 18, 2005

(30) Foreign Application Priority Data

Feb. 12, 2004 (JP) ..... 2004-035447
Feb. 13, 2004 (JP) ..... 2004-036330

(51) Int. Cl.
*F25B 41/00* (2006.01)

(52) U.S. Cl. ..... 62/513; 62/476

(58) Field of Classification Search ..... 62/190, 62/228.1, 509, 513
See application file for complete search history.

(56) References Cited

U.S. PATENT DOCUMENTS 6,105,386 A * 8/2000 Kuroda et al. ..... 62/513
6,134,900 A * 10/2000 Nishida et al. ..... 62/216

FOREIGN PATENT DOCUMENTS

JP 7-18602 3/1995

* cited by examiner

*Primary Examiner*—Melvin Jones
(74) *Attorney, Agent, or Firm*—Armstrong, Kratz, Quintos, Hanson & Brooks, LLP.

(57) ABSTRACT

For a purpose of preventing a compressor from being damaged by liquid compression without disposing any accumulator on a low-pressure side, there is disclosed a transition critical refrigerant cycle apparatus having a supercritical pressure on a high-pressure side. The transition critical refrigerant cycle apparatus constituted by connecting a compressor, a gas cooler, a pressure reducing device, an evaporator and the like in an annular shape, using carbon dioxide as a refrigerant, and capable of having the supercritical pressure on the high-pressure side comprises: an internal heat exchanger for exchanging heat between a refrigerant which has flown out of the gas cooler and a refrigerant which has flown out of the evaporator. This internal heat exchanger comprises a high-pressure-side channel through which the refrigerant from the gas cooler flows, and a low-pressure-side channel which is disposed in a heat exchanging manner with this high-pressure-side channel and through which the refrigerant from the evaporator flows, the refrigerant is passed upwards from below in the high-pressure-side channel, and the refrigerant is passed downwards from above in the low-pressure-side channel.

5 Claims, 6 Drawing Sheets

REFRIGERANT CYCLE APPARATUS

BACKGROUND OF THE INVENTION

1. Field of the Invention

The present invention relates to a refrigerant cycle apparatus constituted by connecting a compressor, a gas cooler, a pressure reducing device, an evaporator and the like in an annular shape, using carbon dioxide as a refrigerant, and capable of having a supercritical pressure on a high-pressure side.

2. Description of the Related Art

In this type of refrigerant cycle apparatus, a rotary compressor, a gas cooler, a pressure reducing device (expansion valve, capillary tube, etc.), an evaporator and the like have heretofore been successively piped/connected in an annular shape to constitute a refrigerant cycle (refrigerant circuit). Moreover, a refrigerant gas is sucked on the side of a low-pressure chamber of a cylinder from a suction port of a rotary compression element of a rotary compression, compressed by operations of a roller and a vane to constitute a high-temperature/pressure refrigerant gas, and discharged to the gas cooler from a high-pressure chamber side via a discharge port and a discharge-noise silencing chamber. After the refrigerant gas radiates heat in this gas cooler, the gas is throttled by throttle means, and supplied to the evaporator. There, the refrigerant evaporates, and absorbs heat from surroundings at this time to thereby exert a cooling function.

Here, in recent years, to handle global environmental problems, apparatuses have been developed in which carbon dioxide ($CO_2$) that is a natural refrigerant is used without using conventional chlorofluorocarbon even in this type of refrigerant cycle and in which a transition critical refrigerant cycle is used for operation at a supercritical pressure on a high-pressure side.

In this transition critical refrigerant cycle apparatus, to prevent a liquid refrigerant from being returned into the compressor and compressed, an accumulator has been disposed on a low-pressure side between an outlet side of the evaporator and a suction side of the compressor in such a manner as to accumulate the liquid refrigerant in this accumulator, and suck a gas only into the compressor. Moreover, the pressure reducing device has been adjusted in such a manner that the liquid refrigerant in the accumulator does not return to the compressor (see, e.g., Japanese Patent Publication No. 7-18602).

However, when the accumulator is disposed on the low-pressure side of the refrigerant cycle, more refrigerant charge amount is required. To prevent liquid backflow, a capacity of the accumulator has to be increased, and throttle of the pressure reducing device has to be adjusted. This has resulted in enlargement of an installation space or drop of refrigeration capability in an evaporator 15.

Moreover, since a compression ratio is very high in a case where carbon dioxide is used as the refrigerant of the refrigerant cycle apparatus, it has been difficult to derive a refrigeration capability at high temperature of outside air or the like.

SUMMARY OF THE INVENTION

To solve conventional technical problems, an object of the present invention is to provide a transition critical refrigerant cycle apparatus having a supercritical pressure on a high-pressure side, in which a compressor is prevented from being damaged by liquid compression without disposing any accumulator on a low-pressure side.

According to the present invention, there is provided a transition critical refrigerant cycle apparatus constituted by connecting a compressor, a gas cooler, a pressure reducing device, an evaporator and the like in an annular shape, using carbon dioxide as a refrigerant, and capable of having a supercritical pressure on a high-pressure side, the apparatus comprising: an internal heat exchanger for exchanging heat between a refrigerant which has flown out of the gas cooler and a refrigerant which has flown out of the evaporator, wherein the internal heat exchanger comprises a high-pressure-side channel through which the refrigerant from the gas cooler flows, and a low-pressure-side channel which is disposed in a heat exchanging manner with this high-pressure-side channel and through which the refrigerant from the evaporator flows, the refrigerant is passed upwards from below in the high-pressure-side channel, and the refrigerant is passed downwards from above in the low-pressure-side channel.

Moreover, in the refrigerant cycle apparatus of the present invention, the internal heat exchanger in the above-described invention comprises a double tube comprising inner and outer tubes, the high-pressure-side channel is disposed in the inner tube, and the low-pressure-side channel is disposed between the inner tube and the outer tube.

Furthermore, in the refrigerant cycle apparatus of the present invention, the internal heat exchanger in the above-described invention comprises a stacked plate comprising two system channels therein, one channel is constituted as the high-pressure-side channel, and the other channel is constituted as the low-pressure-side channel.

In the present invention, the apparatus comprises the internal heat exchanger for exchanging the heat between the refrigerant which has flown out of the gas cooler and the refrigerant which has flown out of the evaporator, and the internal heat exchanger comprises the high-pressure-side channel through which the refrigerant from the gas cooler flows, and the low-pressure-side channel which is disposed in the heat exchanging manner with the high-pressure-side channel and through which the refrigerant from the evaporator flows. Therefore, the temperature of the refrigerant entering the pressure reducing device from the gas cooler is lowered by the internal heat exchanger to thereby enlarge an entropy difference in the evaporator, and a refrigeration capability can be enhanced.

Especially, the refrigerant is passed upwards from below in the high-pressure-side channel, and passed downwards from above in the low-pressure-side channel. Therefore, when high pressure lowers below supercritical pressure, surplus refrigerant can be accumulated in the high-pressure-side channel of the internal heat exchanger. The surplus refrigerant flowing in on the low-pressure side at low outside-air temperature or the like is reduced, and a disadvantage such as breakage of the compressor can be avoided in advance.

Moreover, the double tube constitutes the internal heat exchanger, or the internal heat exchanger is constituted in a stacked system. Therefore, the heat exchange between the refrigerant from the gas cooler and the refrigerant from the evaporator is smoothly performed, and the refrigerant can be accumulated in the high-pressure-side channel at the low outside-air temperature or the like without any problem.

Furthermore, to solve the conventional technical problem, an object of the present invention is to enhance the refrigeration capability in the evaporator in the refrigerant cycle apparatus.

That is, according to the present invention, there is provided a refrigerant cycle apparatus constituted by connecting a compressor, a gas cooler, a pressure reducing device, an evaporator and the like in an annular shape, using carbon dioxide as the refrigerant, and having a supercritical pressure on a high-pressure side, the apparatus comprising: an internal heat exchanger for exchanging heat between a refrigerant which has flown out of the gas cooler and a refrigerant which has flown out of the evaporator, wherein a ratio of a low-pressure portion volume in a cycle is set to 30% or more and 50% or less of a total volume, and a ratio of the low-pressure portion volume in the internal heat exchanger is set to 5% or more and 30% or less with respect to a total volume of a whole low-pressure portion in the cycle.

Furthermore, in the refrigerant cycle apparatus of the present invention, the compressor in the above-described invention comprises first and second compression elements disposed in a sealed container, an intermediate-pressure refrigerant compressed by the first compression element and discharged into the sealed container is compressed and discharged by the second compression element, and a ratio of an intermediate-pressure portion volume in the cycle is set to 20% or more and 50% or less of a total volume.

Additionally, according to the present invention, the refrigerant cycle apparatus of the above-described invention comprises: an intermediate cooling circuit for cooling the intermediate-pressure refrigerant discharged into the sealed container from the first compression element, and thereafter allowing the second compression element to suck the refrigerant.

In the present invention, the liquid refrigerant can be returned to the internal heat exchanger from the evaporator in the form of a liquid/gas mixed phase flow having a satisfactory heat transfer property without being completely evaporated in the evaporator. The temperature of the refrigerant on the high-pressure side which enters the pressure reducing device from the gas cooler is effectively lowered by enhancement of a heat transfer characteristic and effective use of latent•sensible heat of the refrigerant, and an enthalpy difference in the evaporator can be maximized to thereby enhance a refrigeration capability.

Especially, when the inner intermediate pressure-type two-stage compression system compressor is used, for example, a ratio of an intermediate pressure portion volume in the cycle including, for example, the intermediate cooling circuit is set to 20% or more and 50% or less of the total volume, and accordingly the above-described effect can be exerted to the maximum.

DETAILED DESCRIPTION OF THE PREFERRED EMBODIMENTS

Embodiments of the present invention will be described hereinafter in detail with reference to the drawings.

(Embodiment 1)

Figure 1:
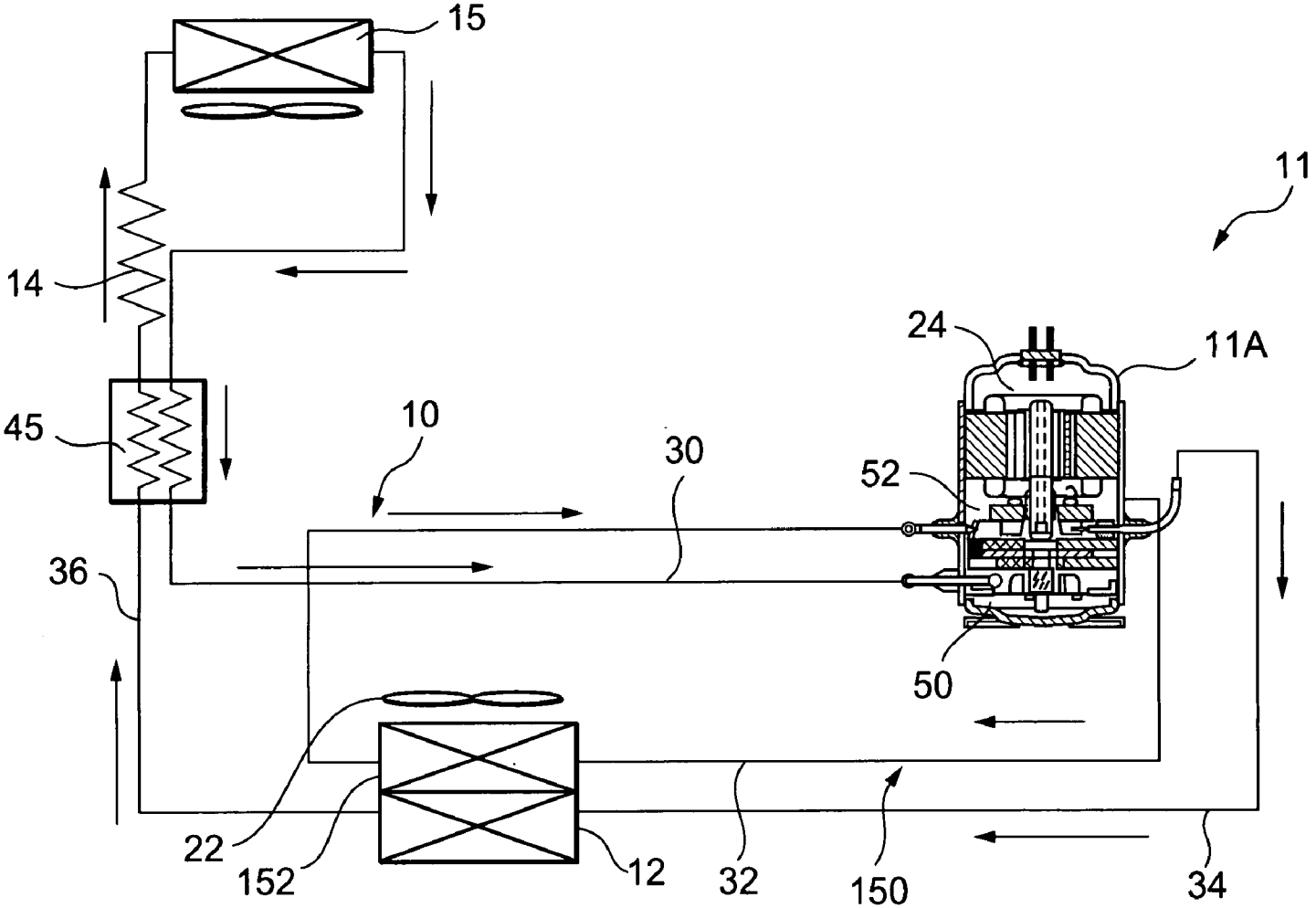
FIG. 1 is a refrigerant circuit diagram of a transition critical refrigerant cycle apparatus according to one embodiment of the present invention (Embodiment 1)

FIG. 1 is a refrigerant circuit diagram of a transition critical refrigerant cycle apparatus according to one embodiment of the present invention. It is to be noted that the transition critical refrigerant cycle apparatus of the present invention is used in an automatic vending machine, an air conditioner, a refrigerator, a showcase or the like.

In FIG. 1, reference numeral 10 denotes a refrigerant circuit of a transition critical refrigerant cycle apparatus 1, and a compressor 11, a gas cooler 12, a capillary tube 14 which is a pressure reducing device, an evaporator 15 and the like are connected in an annular shape to constitute the circuit.

That is, a refrigerant discharge tube 34 of the compressor 11 is connected to an inlet of the gas cooler 12. Here, the compressor 11 of the present embodiment is an inner intermediate-pressure type two-stage compression system rotary compressor, and comprises an electromotive element 24 which is a driving element, and first and second rotary compression elements 50, 52 driven by the electromotive element 24 in a sealed container 11A.

In the figure, reference numeral 30 denotes a refrigerant introducing tube for introducing refrigerant into the first rotary compression element 50 of the compressor 11, and one end of this refrigerant introducing tube 30 communicates with a cylinder (not shown) of the first rotary compression element 50. The other end of the refrigerant introducing tube 30 is connected to an outlet 66B of a low-pressure-side channel 66 of an internal heat exchanger 45 described later.

In the figure, reference numeral 32 denotes a refrigerant introducing tube for introducing the refrigerant compressed by the first rotary compression element 50 into the second rotary compression element 52. The refrigerant introducing tube 32 is disposed in such a manner as to extend through an intermediate cooling circuit 150 outside the compressor 11. In the intermediate cooling circuit 150, a heat exchanger 152 for cooling the refrigerant compressed by the first rotary compression element 50 is disposed, and the refrigerant having an intermediate pressure compressed by the first rotary compression element 50 is cooled by the heat exchanger 152, and thereafter sucked into the second rotary compression element 52. This heat exchanger 152 is formed integrally with the gas cooler 12, and a fan 22 for passing air through the heat exchanger 152 and the gas cooler 12 to radiate heat from the refrigerant is disposed in the vicinity of the heat exchanger 152 and the gas cooler 12. It is to be noted that the refrigerant discharge tube 34 is a refrigerant pipe for discharging the refrigerant compressed by the second rotary compression element 52 to the gas cooler 12.

Figure 2:
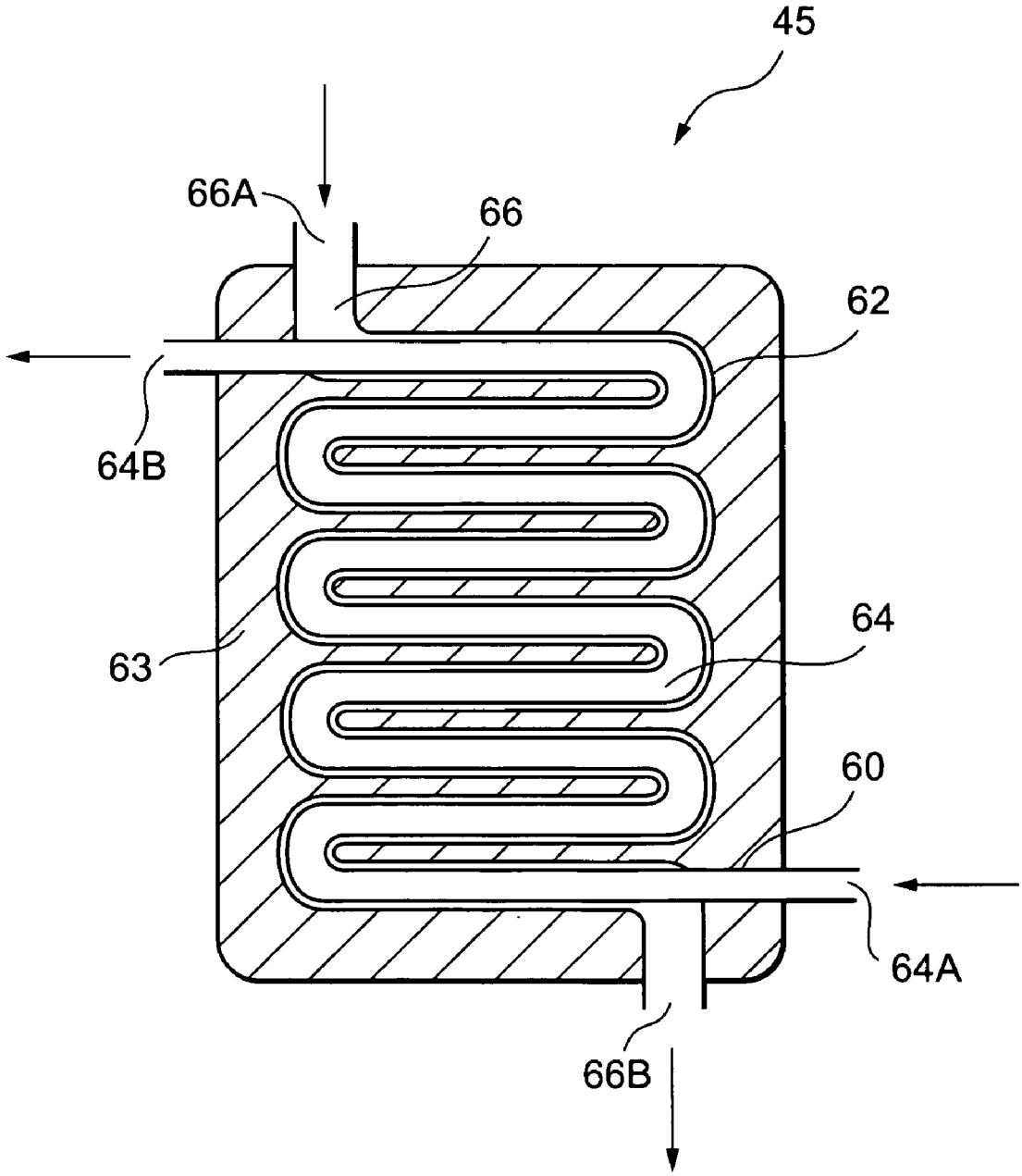
FIG. 2 is an internal constitution diagram of an internal heat exchanger of FIG. 1.

On the other hand, a refrigerant pipe 36 connected to the gas cooler 12 on an outlet side is connected to an inlet 64A of a high-pressure-side channel 64 of the internal heat exchanger 45. The above-described internal heat exchanger 45 exchanges the heat between a refrigerant which has flown out of the gas cooler 12 on a high-pressure side and a refrigerant which has flown out of the evaporator 15 on a low-pressure side. As shown in FIG. 2, the internal heat exchanger 45 comprises a double tube constituted of an inner tube 60 and an outer tube 62 as shown in FIG. 2, and an outer periphery of the outer tube 62 is covered with an insulating material 63. Moreover, the high-pressure-side channel 64 through which the refrigerant from the gas cooler flows is disposed in the inner tube 60, a low-pressure-side channel 66 through which the refrigerant from the evaporator 15 is formed between the inner tube 60 and the outer tube 62, and the high-pressure-side channel 64 and the low-pressure-side channel 66 are disposed in a heat exchange manner.

Moreover, the inlet 64A is formed on a lower side, and an outlet 64B is formed on an upper side in such a manner that the refrigerant is passed upwards from below in the high-pressure-side channel 64. That is, it is assumed that the high-pressure-side refrigerant from the gas cooler 12 enters the high-pressure-side channel 64 from the lower inlet 64A, and flows out of the high-pressure-side channel 64 from the upper outlet 64B.

On the other hand, an inlet 66A is formed in an upper end, and the outlet 66B is formed in a lower end in such a manner as to pass the refrigerant downwards from above in the low-pressure-side channel 66. That is, it is assumed that the low-pressure-side refrigerant from the evaporator 15 enters the low-pressure-side channel 66 from the upper-end inlet 66A, and flows out of the low-pressure-side channel 66 from the lower-end outlet 66B.

Accordingly, since the refrigerants flowing through the high-pressure-side channel 64 and the low-pressure-side channel 66 constitute countercurrents, a heat exchange capability in the internal heat exchanger 45 is enhanced.

Furthermore, the refrigerant is passed upwards from below in the high-pressure-side channel 64, and passed downwards from above in the low-pressure-side channel 66. In a case where the high pressure lowers below the supercritical pressure, surplus refrigerant can be accumulated in the high-pressure-side channel 64 of the internal heat exchanger 45. Accordingly, the surplus refrigerant flowing in the low-pressure side at low outside-air temperature or the like is reduced, and a disadvantage such as breakage of the compressor 11 can be avoided in advance.

On the other hand, the pipe connected to the outlet 64B of the high-pressure-side channel 64 of the internal heat exchanger 45 is connected to the evaporator 15 via the capillary tube 14. Moreover, the pipe extending from the evaporator 15 is connected to the inlet 66A of the low-pressure-side channel 66 of the internal heat exchanger 45.

It is to be noted that carbon dioxide ($CO_2$) which is a natural refrigerant is used as the refrigerant of the transition critical refrigerant cycle apparatus 1 in consideration of global environment, flammability, toxicity and the like, and the refrigerant circuit 10 of the transition critical refrigerant cycle apparatus 1 on the high-pressure side has a supercritical pressure.

Next, an operation of the transition critical refrigerant cycle apparatus 1 of the present embodiment constituted as described above will be described. When the electromotive element 24 of the compressor 11 is started, the low-pressure refrigerant gas is sucked and compressed by the first rotary compression element 50 of the compressor 11, has an intermediate pressure, and is discharged into the sealed container 11A. The refrigerant discharged into the sealed container 11A is once discharged to the outside of the sealed container 11A from the refrigerant introducing tube 32, enters the intermediate cooling circuit 150, and passes through the heat exchanger 152. Then, the refrigerant receives air passing by the fan 22 to radiate the heat.

Thus, after the refrigerant compressed by the first rotary compression element 50 is cooled by the heat exchanger 152, the refrigerant is sucked into the second rotary compression element 52, and accordingly the temperature of the refrigerant gas discharged from the second rotary compression element 52 of the compressor 11 can be lowered.

Thereafter, the refrigerant is sucked and compressed by the second rotary compression element 52, constitutes a high-temperature/pressure refrigerant gas, and is discharged to the outside of the compressor 11 from the refrigerant discharge tube 34. At this time, the refrigerant is compressed to an appropriate supercritical pressure.

The refrigerant discharged from the refrigerant discharge tube 34 flows in the gas cooler 12, there receives air flow by the fan 22 to radiate the heat, and flows in the high-pressure-side channel 64 formed in the inner tube 60 from the inlet 64A of the high-pressure-side channel 64 of the internal heat exchanger 45. Moreover, the refrigerant which has entered the high-pressure-side channel 64 flows upwards from below in the high-pressure-side channel 64. Here, since the high-pressure-side channel 64 and the low-pressure-side channel 66 are disposed in a heat exchange manner as described above, the heat of the refrigerant flowing through the high-pressure-side channel 64 from the gas cooler 12 is taken by the refrigerant flowing through the low-pressure-side channel 66 from the evaporator 15, and the refrigerant is cooled.

Accordingly, since the temperature of the refrigerant entering the capillary tube 14 from the gas cooler 12 can be lowered, an entropy difference in the evaporator 15 can be enlarged. Therefore, the refrigeration capability in the evaporator 15 can be enhanced.

On the other hand, the high-pressure-side refrigerant which has been cooled in the internal heat exchanger 45 and flown from the outlet 64B reaches the capillary tube 14. It is to be noted that the refrigerant gas still has a gas state in the inlet to the capillary tube 14. The refrigerant is brought into two-phase mixed state of gas/liquid by pressure drop in the capillary tube 14, and flows into the evaporator 15 in the state. There the refrigerant evaporates, and absorbs heat from air to thereby exert a cooling function.

At this time, by an effect of cooling the intermediate-pressure refrigerant in the intermediate cooling circuit 150 as described above, and an effect of cooling the refrigerant in the internal heat exchanger 45 to enlarge the entropy difference in the evaporator 15, the refrigeration capability in the evaporator 15 can be enhanced.

Thereafter, the refrigerant flows out of the evaporator 15, and enters the low-pressure-side channel 66 between the inner tube 60 and the outer tube 62 of the internal heat exchanger 45 from the inlet 66A. Moreover, the refrigerant which has entered the low-pressure-side channel 66 flows downwards from above in the low-pressure-side channel 66 between the inner tube 60 and the outer tube 62. Here, the refrigerant which has evaporated at low temperature in the evaporator 15 and flown out of the evaporator 15 is not completely brought into a gas state, and is brought into a liquid mixed state. However, when the refrigerant is passed through the low-pressure-side channel 66 of the internal heat exchanger 45, and exchanges the heat with the refrigerant flowing through the high-pressure-side channel 64, the refrigerant is heated, a superheating degree of the refrigerant is secured at this time, and the refrigerant is completely brought into the gas state.

Accordingly, a disadvantage that the liquid refrigerant is sucked into the compressor 11 to break the compressor 11 can be avoided in advance.

It is to be noted that the refrigerant heated by the internal heat exchanger 45 repeats a cycle of being sucked into the first rotary compression element 50 from the refrigerant introducing tube 30.

Thus, the internal heat exchanger 45 is disposed having the high-pressure-side channel 64 through which the refrigerant from the gas cooler 12 flows, and the high-pressure-side channel 64 which is disposed in the heat exchange manner with the high-pressure-side channel 64 and through which the refrigerant from the evaporator 15 flows. Accordingly, the temperature of the refrigerant entering the capillary tube 14 from the gas cooler 12 is lowered, and the entropy difference in the evaporator 15 can be enlarged to thereby enhance the refrigeration capability.

Especially, the refrigerant is passed upwards from below in the high-pressure-side channel 64, and passed downwards from above in the low-pressure-side channel 66. Therefore, in a case where the high pressure lowers below the supercritical pressure, the surplus refrigerant can be accumulated in the high-pressure-side channel 64 of the internal heat exchanger 45, the surplus refrigerant flowing in the low-pressure side at the low outside-air temperature or the like is reduced, and the disadvantage of the breakage of the compressor 11 or the like can be avoided in advance.

Moreover, the internal heat exchanger 45 comprises a double tube constituted of the inner tube 60 and the outer tube 62, the high-pressure-side channel 64 is constituted in the inner tube 60, and the low-pressure-side channel 66 is constituted between the inner tube 60 and the outer tube 62. Therefore, the refrigerant from the gas cooler 12 can smoothly exchange the heat with the refrigerant from the evaporator 15. Furthermore, the refrigerant can be accumulated in the high-pressure-side channel 64 at the low outside-air temperature or the like without any trouble.

Accordingly, reliability of the transition critical refrigerant cycle apparatus 1 is enhanced, and the refrigeration capability can be enhanced.

It is to be noted that in the present embodiment, the internal heat exchanger 45 is structured in a double tube constituted of the inner tube 60 and outer tube 62, but the present invention is not limited to this embodiment, and the steel plate in which two system channels are constituted may be stacked to constitute the exchanger.

Even in this case, one channel is disposed as the high-pressure-side channel, the other channel is disposed as the low-pressure-side channel, and both the channels are disposed in the heat exchange manner. Moreover, the refrigerant is passed upwards from below in the high-pressure-side channel, and the refrigerant is passed downwards from above in the low-pressure-side channel, so that an effect similar to that of the present embodiment can be obtained.

(Embodiment 2)

Figure 3:
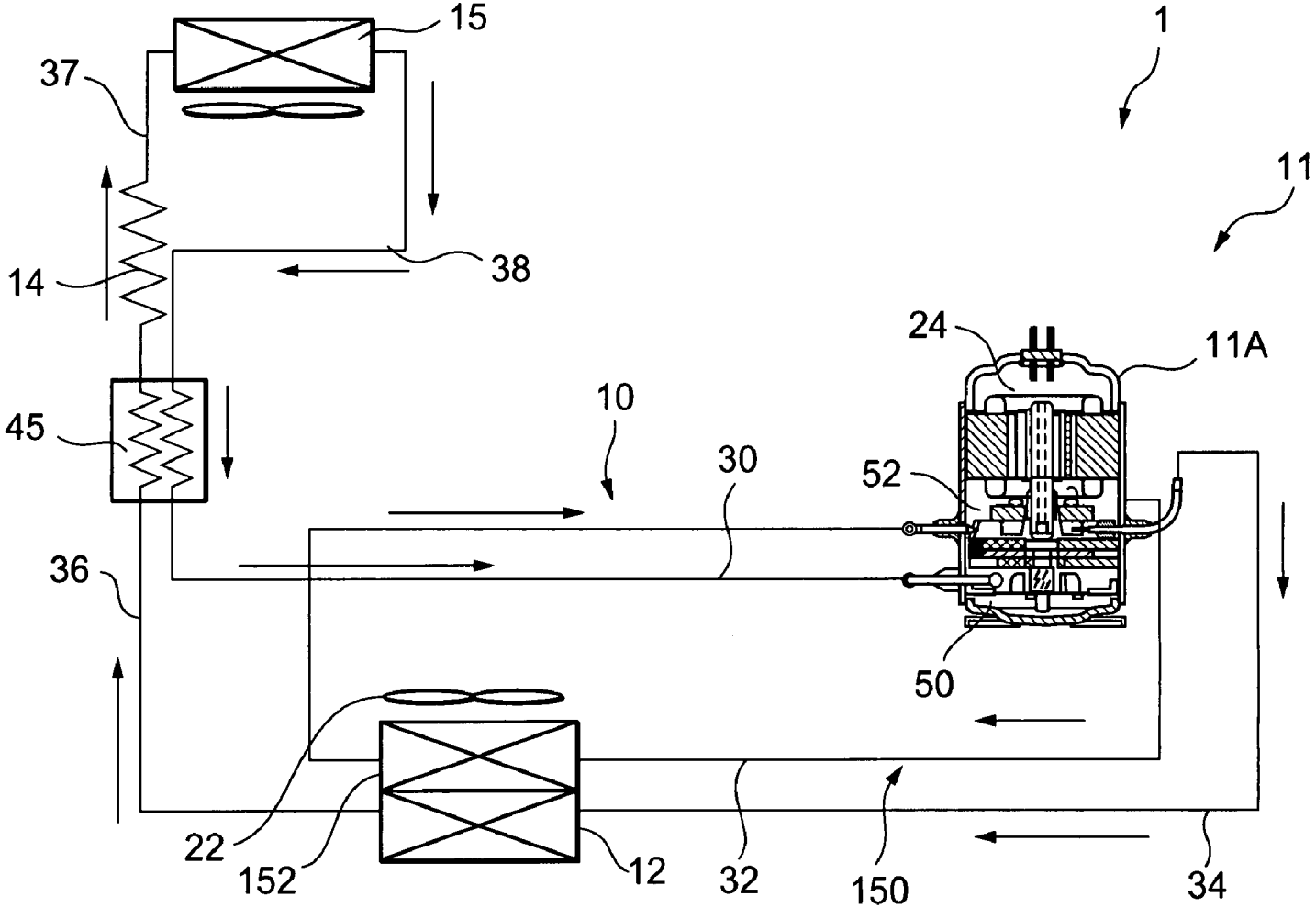
FIG. 3 is a refrigerant circuit diagram of the refrigerant cycle apparatus according to another embodiment of the present invention (Embodiment 2)

Next, FIG. 3 is a refrigerant circuit diagram of a refrigerant cycle apparatus according to another embodiment of the present invention. It is to be noted that this refrigerant cycle apparatus is also used in an automatic vending machine, an air conditioner, a refrigerator, a showcase or the like.

In FIG. 3, reference numeral 10 denotes a refrigerant circuit of a refrigerant cycle apparatus 1, and a compressor 11, a gas cooler 12, a capillary tube 14 which is a pressure reducing device, an evaporator 15 and the like are connected in an annular shape to constitute the circuit.

That is, a refrigerant discharge tube 34 of the compressor 11 is connected to an inlet of the gas cooler 12. Here, the compressor 11 of the present embodiment is an inner intermediate-pressure type two-stage compression system rotary compressor, and comprises an electromotive element 24 which is a driving element, and first and second rotary compression elements 50, 52 driven by the electromotive element 24 in a sealed container 11A. An intermediate-pressure refrigerant compressed by the first rotary compression element 50 and discharged into the sealed container 11A is compressed by the second rotary compression element 52, and discharged.

In the figure, reference numeral 30 denotes a refrigerant introducing tube for introducing the refrigerant into the first rotary compression element 50 of the compressor 11, and one end of this refrigerant introducing tube 30 communicates with a cylinder (not shown) of the first rotary compression element 50. The other end of the refrigerant introducing tube 30 is connected to a low-pressure-side outlet of an internal heat exchanger 45 described later.

In the figure, reference numeral 32 denotes a refrigerant introducing tube for introducing the refrigerant compressed by the first rotary compression element 50 into the second rotary compression element 52, and the tube is disposed in such a manner as to extend through an intermediate cooling circuit 150 outside the compressor 11. In the intermediate cooling circuit 150, after cooling the intermediate-pressure refrigerant discharged into the sealed container 11A from the first rotary compression element 50 by a heat exchanger 152 disposed in the intermediate cooling circuit 150, the refrigerant is sucked into the second rotary compression element 52.

Moreover, the heat exchanger 152 is formed integrally with the gas cooler 12, and a fan 22 for passing air through the heat exchanger 152 and the gas cooler 12 to radiate heat from the refrigerant is disposed in the vicinity of the heat exchanger 152 and the gas cooler 12. It is to be noted that the refrigerant discharge tube 34 is a refrigerant pipe for discharging the refrigerant compressed by the second rotary compression element 52 to the gas cooler 12.

On the other hand, a refrigerant pipe 36 connected to the gas cooler 12 on an outlet side is connected to an inlet of the internal heat exchanger 45 on the high-pressure side. The above-described internal heat exchanger 45 exchanges the heat between a refrigerant which has flown out of the gas cooler 12 on the high-pressure side and a refrigerant which has flown out of the evaporator 15 on a low-pressure side.

Moreover, a refrigerant pipe 37 connected to the outlet of the internal heat exchanger 45 on the high-pressure side extends through the capillary tube 14, and is connected to the inlet of the evaporator 15. The refrigerant pipe 38 extending out of the evaporator 15 reaches the inlet of the internal heat exchanger 45 on the low-pressure side. Moreover, the outlet of the internal heat exchanger 45 on the low-pressure side is connected to the refrigerant introducing tube 30.

It is to be noted that carbon dioxide which is a natural refrigerant is used as the refrigerant of the refrigerant cycle apparatus 1 in consideration of global environment, flammability, toxicity and the like. The refrigerant circuit 10 of the refrigerant cycle apparatus 1 on the high-pressure side has a supercritical pressure.

Here, by the operation of the compressor 11 in the refrigerant cycle apparatus 1, a high-pressure portion through which a high-pressure refrigerant flows, an intermediate-pressure portion through which an intermediate-pressure refrigerant flows, and a low-pressure portion through which a low-pressure refrigerant flows are generated in the refrigerant circuit 10.

The high-pressure portion in the refrigerant circuit 10 is a path extending to the inlet of the capillary tube 14 from the refrigerant discharge tube 34 through which the refrigerant compressed by the second rotary compression element 52 flows in a high-pressure state in the refrigerant circuit 10 via the gas cooler 12, and the high-pressure side of the internal heat exchanger 45.

Moreover, the intermediate-pressure portion is the inside of the refrigerant introducing tube 32 including the intermediate cooling circuit 150 through which the intermediate-pressure refrigerant compressed by the first rotary compression element 50 flows.

The low-pressure portion is a path extending to the refrigerant introducing tube 30 from the refrigerant pipe 38 through which the refrigerant having the pressure reduced in the capillary tube 14 flows via the evaporator 15 and the low-pressure side of the internal heat exchanger 45.

Moreover, in the refrigerant cycle apparatus 1 of the present invention, a ratio of a low-pressure portion volume in the cycle (in the refrigerant circuit 10) is set to 30% or more and 50% or less of the total volume, and the ratio of the low-pressure portion volume in the internal heat exchanger 45 is se to 5% or more and 30% or less with respect to the whole volume of the low-pressure portion in the cycle.

When the ratio of the low-pressure portion volume is set in this manner, the refrigerant in the outlet of the evaporator 15 is not completely brought into a gas state, and can be brought into a damp state even on any operation condition. Moreover, the refrigerant is completely brought into the gas state on the low-pressure side of the internal heat exchanger 45, and a superheating degree can be secured. Accordingly, the liquid refrigerant can be returned to the internal heat exchanger 45 from the evaporator 15 in the form of a mixed phase flow (damp state) of liquid/gas having a satisfactory heat transfer property without being completely evaporated in the evaporator 15. Therefore, the heat transfer characteristic can be enhanced, latent•sensible heat of the refrigerant can be effectively utilized, and the temperature of the refrigerant on the high-pressure side entering the capillary tube 14 from the gas cooler 12 can be effectively lowered. Accordingly, the enthalpy difference in the evaporator 15 can be maximized, and the refrigeration capability can be enhanced.

Especially, the refrigeration capability can be sufficiently secured even on a condition on which the refrigeration capability at high outside-air temperature or the like cannot be easily derived.

Furthermore, in the present embodiment, the ratio of the intermediate-pressure portion volume in the refrigerant circuit 10 including the intermediate cooling circuit 150 is set to 20% or more and 50% or less of the total volume.

When the volume of the intermediate-pressure portion is set in this manner, the refrigerant gas sucked into the second rotary compression element 52 can be sufficiently cooled without being liquefied. Accordingly, the temperature of the refrigerant gas discharged from the second rotary compression element 52 can also be lowered.

Accordingly, the refrigeration capability in the evaporator 15 can be further enhanced.

Next, an operation of the refrigerant cycle apparatus 1 constituted as described above in this case will be described with reference to FIG. 4. FIG. 1 is a p-h graph (Mollier diagram) of the refrigerant cycle apparatus 1, a solid line shows a p-h graph at usual outside-air temperature (outside-air temperature of +32° C.), and a broken line shows a p-h graph at low outside-air temperature (outside-air temperature of +5° C.). It is to be noted that in FIG. 4, the ordinate indicates pressure, and the abscissa indicates enthalpy.

Figure 4:
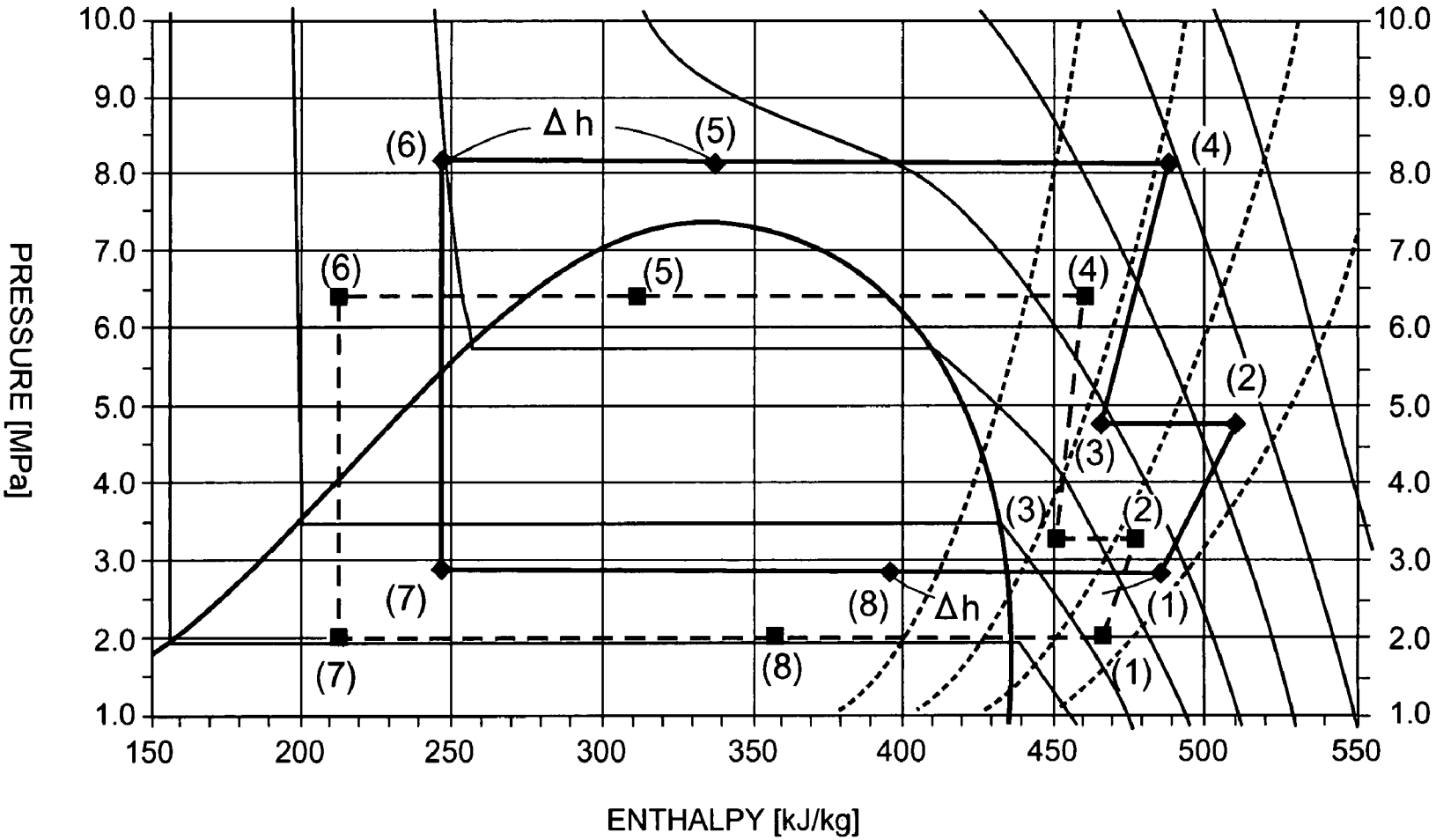
FIG. 4 is a p-h graph of the refrigerant cycle apparatus of FIG. 3.

When the electromotive element 24 of the compressor 11 is started, the low-pressure refrigerant gas is sucked into the first rotary compression element 50 from the refrigerant introducing tube 30 (state of solid line (1) of FIG. 4), compressed to thereby indicate an intermediate pressure, and is discharged into the sealed container 11A (state of solid line (2) of FIG. 4). The refrigerant discharged into the sealed container 11A is once discharged to the outside of the sealed container 11A from the refrigerant introducing tube 32, enters the intermediate cooling circuit 150, and passes through the heat exchanger 152. Then, the refrigerant receives the air flow by the fan 22 to radiate the heat (state of solid line (3) of FIG. 4).

Thus, the intermediate-pressure refrigerant gas compressed by the first rotary compression element 50 is passed through the intermediate cooling circuit 150, and can be accordingly effectively cooled by the heat exchanger 152. Therefore, temperature rise in the sealed container 11A is suppressed, and compression efficiency in the second rotary compression element 52 can be enhanced. Furthermore, the temperature of the refrigerant gas discharged from the second rotary compression element 52 can be suppressed to be low.

Thereafter, the refrigerant is sucked and compressed by the second rotary compression element 52 to constitute a high-temperature/pressure refrigerant gas, and discharged to the outside of the compressor 11 from the refrigerant discharge tube 34. At this time, the refrigerant is compressed to an appropriate supercritical pressure (state of solid line (4) of FIG. 4).

The refrigerant discharged from the refrigerant discharge tube 34 flows in the gas cooler 12, there receives the air flow by the fan 22 to radiate the heat (state of solid line (5) of FIG. 4), and flows in the internal heat exchanger 45 on the high-pressure side. Here, the heat of the high-temperature/pressure refrigerant from the gas cooler 12 is taken by a low-temperature/pressure refrigerant from the evaporator 15, and the refrigerant is cooled (state of solid line (6) of FIG. 4).

This state will be described with reference to FIG. 4. That is, when the internal heat exchanger 45 is not disposed, the enthalpy of the refrigerant in the inlet of the capillary tube 14 has a state shown by (5). In this case, the refrigerant temperature in the evaporator 15 rises. On the other hand, when the heat is exchanged with the low-pressure-side refrigerant in the internal heat exchanger 45, the enthalpy of the refrigerant lowers by $\Delta h1$, and has a state shown by (6) of FIG. 4. Therefore, the refrigerant temperature in the evaporator 15 becomes lower than that of the enthalpy of (5) of FIG. 4.

Especially, in the present invention, as described above, the refrigerant on the high-pressure side of the internal heat exchanger 45 exchanges the heat with the refrigerant having a good heat transfer property in the form of a mixed phase flow of liquid/gas on the low-pressure side. Therefore, the temperature of the refrigerant on the high-pressure side can be effectively lowered.

Accordingly, since the temperature of the refrigerant entering the capillary tube 14 from the gas cooler 12 can be lowered by $\Delta h1$, an entropy difference in the evaporator 15 can be enlarged. Therefore, the refrigeration capability in the evaporator 15 can be enhanced.

On the other hand, the high-pressure-side refrigerant which has been cooled in the internal heat exchanger 45 and flown out of the internal heat exchanger 45 reaches the capillary tube 14. It is to be noted that the refrigerant gas still has a supercritical state in the inlet to the capillary tube 14. The refrigerant is formed into a mixed phase flow of liquid/gas by pressure drop in the capillary tube 14, and flows into the evaporator 15 in the state (state of solid line (7) of FIG. 4). There the refrigerant absorbs the heat from air to thereby exert a cooling function.

At this time, by an effect of cooling the refrigerant in the intermediate cooling circuit 150 as described above, and an effect of cooling the refrigerant in the internal heat exchanger 45 to enlarge the enthalpy difference in the evaporator 15, the refrigeration capability in the evaporator 15 can be enhanced.

Thereafter, the refrigerant flows out of the evaporator 15 (state of solid line (8) of FIG. 4), and flows in the internal heat exchanger 45 on the low-pressure side. Here, the refrigerant which has flown out of the evaporator 15 at low temperature is not completely brought into a gas state as described above, and has the form of the mixed phase flow of liquid/gas (damp state). However, when the ratio of the low-pressure portion volume in the internal heat exchanger 45 is set to 5% or more and 30% or less with respect to the volume of the whole low-pressure portion in the refrigerant circuit 10, the heat can be exchanged with the high-pressure-side refrigerant in the internal heat exchanger 45, and a superheating degree can be sufficiently taken. Accordingly, a disadvantage that the liquid refrigerant is sucked into the compressor 11 to break the compressor 11 can be avoided in advance.

Moreover, in the present embodiment, since the inner intermediate-pressure type two-stage compression system rotary compressor is used as the compressor, the temperature in the sealed container 11A becomes lower as compared with an inner high-pressure type. Therefore, even when the superheating degree is sufficiently secured as described above, a disadvantage that the electromotive element 24 in the compressor 11 or the like is superheated to thereby aversely affect the operation does not easily occur.

On the other hand, the refrigerant heated by the internal heat exchanger 45 repeats a cycle of being sucked into the first rotary compression element 50 of the compressor 11 from the refrigerant introducing tube 30.

It is to be noted that in this case, in the refrigerant cycle apparatus 1, as shown by the broken line of FIG. 4, the refrigerant sucked into the compressor 11 by the internal heat exchanger 45 is heated, and the superheating degree can be secured even at low outside-air temperature or the like. That is, as shown by broken line (8) of FIG. 4, the refrigerant is formed into the mixed phase flow of liquid/gas in the outlet of the evaporator 15. However, when the volume is set as described above, the superheating degree of the refrigerant can be taken as shown by the broken line (1) of FIG. 4. Accordingly, the reliability of the refrigerant cycle apparatus 1 can be enhanced.

As described above in detail, the enthalpy difference in the evaporator 15 is maximized, and the refrigeration capability can be enhanced by the refrigerant cycle apparatus 1 of the present invention. When the inner intermediate-pressure type two-stage compression system compressor 11 is used as in the present embodiment, the refrigerant compressed by the first rotary compression element 50 is cooled by the intermediate cooling circuit 150. Moreover, when the ratio of the intermediate-pressure portion in the refrigerant circuit 10 is set to 20% or more and 50% or less of the total volume, the above-described effect can be exerted to the maximum.

(Embodiment 3)

Figure 5:
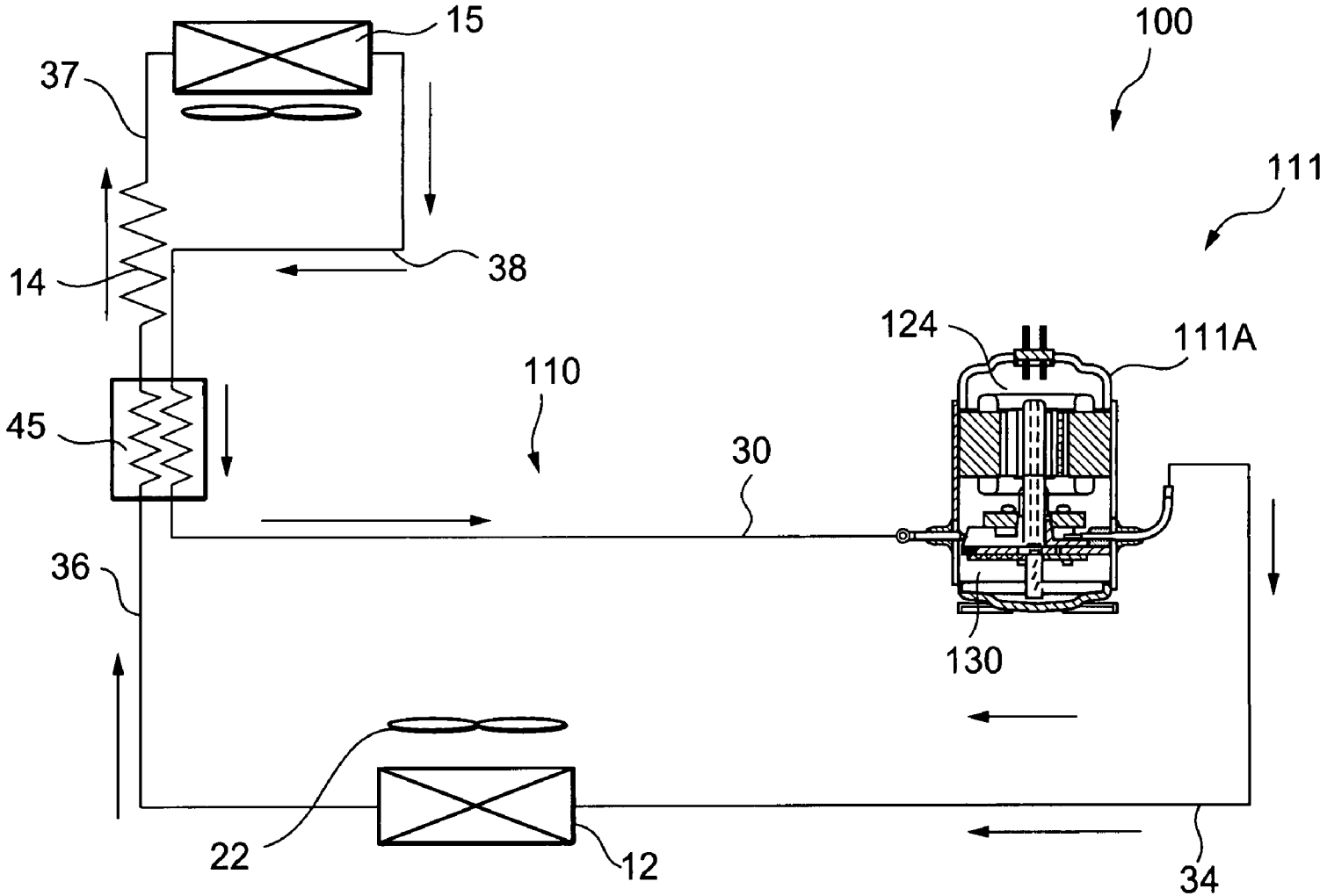
FIG. 5 is a refrigerant circuit diagram of the refrigerant cycle apparatus according to another embodiment of the present invention (Embodiment 3)

Next, another embodiment of a refrigerant cycle apparatus of the present invention will be described. FIG. 5 is a refrigerant circuit diagram of a refrigerant cycle apparatus 100 in this case. It is to be noted that in FIG. 5, components denoted with the same reference numerals as those of FIG. 3 produce similar effects.

In FIG. 5, reference numeral 110 denotes a refrigerant circuit in this case, and a compressor 111, a gas cooler 12, a capillary tube 14 which is a pressure reducing device, an evaporator 15 and the like are connected in an annular shape to constitute the circuit.

Here, the compressor 111 for use in the present embodiment is a single-stage compression system compressor comprising an electromotive element 124 which is a driving element, and a single-stage compression element 130 driven by the electromotive element 124, and one end of a refrigerant introducing tube 30 is connected to the compression element 130 on a suction side. The compression element 130 on a discharge side is connected to a refrigerant discharge tube 34.

That is, the refrigerant discharge tube 34 from the compressor 111 is connected to an inlet of the gas cooler 12. Moreover, a refrigerant pipe 36 connected to the gas cooler 12 on an outlet side is connected to an inlet of the internal heat exchanger 45 on the high-pressure side. The internal heat exchanger 45 also exchanges the heat between a refrigerant which has flown out of the gas cooler 12 on the high-pressure side and a refrigerant which has flown out of the evaporator 15 on a low-pressure side in the same manner as in the above-described embodiment.

Moreover, a refrigerant pipe 37 connected to the outlet of the internal heat exchanger 45 on the high-pressure side extends through the capillary tube 14, and is connected to the inlet of the evaporator 15. A refrigerant pipe 38 extending out of the evaporator 15 reaches the internal heat exchanger 45 on the low-pressure side. Moreover, the outlet of the internal heat exchanger 45 on the low-pressure side is connected to the refrigerant introducing tube 30.

Here, by the operation of the compressor 111 in the refrigerant cycle apparatus 100, a high-pressure portion through which a high-pressure refrigerant flows, and a low-pressure portion through which a low-pressure refrigerant flows are generated in the refrigerant circuit 110. The high-pressure portion in the refrigerant circuit 10 is a path extending to the inlet of the capillary tube 14 from the refrigerant discharge tube 34 through which the refrigerant compressed by the second rotary compression element 52 flows in a high-pressure state in the refrigerant circuit 10 via the gas cooler 12, and the high-pressure side of the internal heat exchanger 45.

Moreover, the low-pressure portion is a path extending to the refrigerant introducing tube 30 from the refrigerant pipe 38 through which the refrigerant having the pressure reduced in the capillary tube 14 flows in the refrigerant circuit 110 via the evaporator 15 and the low-pressure side of the internal heat exchanger 45.

Moreover, in the present invention, a ratio of a low-pressure portion volume in the cycle (refrigerant circuit 110) is set to 30% or more and 50% or less of the total volume, and the ratio of the low-pressure portion volume in the internal heat exchanger is se to 5% or more and 30% or less with respect to the whole volume of the low-pressure portion in the cycle. That is, the high-pressure portion volume occupies remaining 50% or more and 70% or less of the total volume.

When the ratio of the low-pressure portion volume is set in this manner, the refrigerant in the outlet of the evaporator 15 is not completely brought into a gas state, and can be brought into a damp state even on any operation condition at a usual operation time. Moreover, the refrigerant is completely brought into the gas state on the low-pressure side of the internal heat exchanger 45, and a superheating degree can be secured. Accordingly, the liquid refrigerant can be returned to the internal heat exchanger 45 from the evaporator in the form of a mixed phase flow (damp state) of liquid/gas having a satisfactory heat transfer property without being completely evaporated in the evaporator 15. Therefore, the heat transfer characteristic can be enhanced, latent•sensible heat of the refrigerant can be effectively utilized, and the temperature of the refrigerant on the high-pressure side entering the capillary tube 14 from the gas cooler 12 can be effectively lowered. Accordingly, the enthalpy difference in the evaporator 15 can be maximized, and the refrigeration capability can be enhanced.

It is to be noted that carbon dioxide is used as the refrigerant in the refrigerant cycle apparatus 100 in the same manner as in the above-described embodiments. The refrigerant circuit 110 of the refrigerant cycle apparatus 100 on the high-pressure side has a supercritical pressure.

Next, an operation of the refrigerant cycle apparatus 100 constituted as described above in the present embodiment will be described with reference to a p-h graph of FIG. 6. It is to be noted that in FIG. 6, the ordinate indicates pressure, and the abscissa indicates enthalpy.

Figure 6:
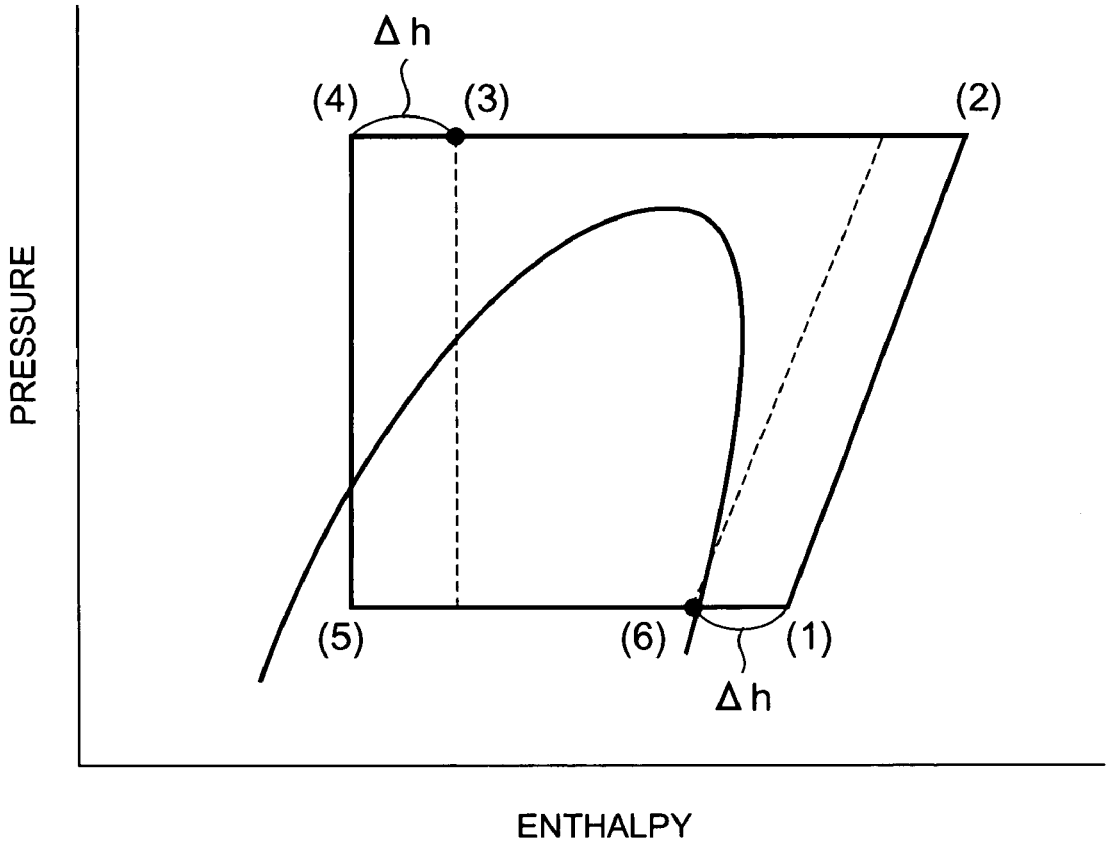
FIG. 6 is a p-h graph of the refrigerant cycle apparatus of FIG. 5.

When the electromotive element 124 of the compressor 111 is started, the low-pressure refrigerant gas is sucked into the compression element 130 from the refrigerant introducing tube 30 (state of (1) of FIG. 6), compressed to thereby constitute a high-temperature/pressure refrigerant gas, and discharged to the outside of the compressor 111 from the refrigerant discharge tube 34. At this time, the refrigerant is compressed to an appropriate supercritical pressure (state of (2) of FIG. 6).

The refrigerant discharged from the refrigerant discharge tube 34 flows in the gas cooler 12, there receives the air flow by the fan 22 to radiate the heat (state of (3) of FIG. 6), and flows in the internal heat exchanger 45 on the high-pressure side. Here, the heat of the high-temperature/pressure refrigerant from the gas cooler 12 is taken by a low-temperature/pressure refrigerant from the evaporator 15, and the refrigerant is cooled (state of (4) of FIG. 6).

Here, in the refrigerant circuit in which the internal heat exchanger 45 is not disposed, the refrigerant on the high-pressure side cannot exchange the heat with that on the low-pressure side. Therefore, it has been impossible to cool the refrigerant on the high-pressure side, and enlarge the enthalpy difference. That is, when the internal heat exchanger 45 is not disposed, the enthalpy of the refrigerant in the inlet of the capillary tube 14 has a state shown by (3), and therefore an evaporation temperature of the refrigerant rises. On the other hand, when the heat is exchanged with the low-pressure-side refrigerant in the internal heat exchanger 45, the enthalpy of the refrigerant lowers by $\Delta h$, and has a state shown by (4) of FIG. 6. Therefore, the refrigerant temperature in the evaporator 15 becomes lower than that of the case of (3) of FIG. 6.

On the other hand, in a refrigerant circuit in which the ratio of the low-pressure portion in the refrigerant circuit is excessively small, or the volume of the evaporator is excessively large with respect to the volume of the internal heat exchanger, the refrigerant in the outlet of the evaporator constantly has a complete gas state. Therefore, by the heat exchange with the refrigerant on the high-pressure side in the internal heat exchanger, the refrigerant on the high-pressure side cannot be sufficiently cooled. Accordingly, the refrigeration capability in the evaporator 15 cannot be sufficiently derived.

However, when the ratio of the low-pressure portion volume in the internal heat exchanger 45 is set to 5% or more and 30% or less with respect to the volume of the whole low-pressure portion in the refrigerant circuit 110 as in the present invention, the refrigerant in the outlet of the evaporator 15 does not have the complete gas state, and can be returned to the internal heat exchanger 45 from the evaporator in the form of the liquid/gas mixed phase flow having a satisfactory heat transfer property. The temperature of the refrigerant on the high-pressure side which enters the capillary tube 14 from the gas cooler 12 can be effectively lowered by enhancement of a heat transfer characteristic and effective use of latent•sensible heat of the refrigerant, and an enthalpy difference in the evaporator 15 can be maximized to thereby enhance a refrigeration capability.

Moreover, the high-pressure-side refrigerant which has been cooled in the internal heat exchanger 45 and flown out of the internal heat exchanger 45 reaches the capillary tube 14. It is to be noted that the refrigerant gas still has a gas state in the inlet to the capillary tube 14. The refrigerant is formed into a mixed phase flow of liquid/gas by pressure drop in the capillary tube 14, and flows into the evaporator 15 in the state (state of (5) of FIG. 6). There the refrigerant absorbs the heat from air to thereby exert a cooling function.

At this time, by an effect of cooling the refrigerant in the internal heat exchanger 45 as described above, the enthalpy difference in the evaporator 15 is enlarged, and therefore the refrigeration capability in the evaporator 15 can be enhanced.

Thereafter, the refrigerant flows out of the evaporator 15 (state of (6) of FIG. 6), and flows in the internal heat exchanger 45 on the low-pressure side. The refrigerant which has flown out of the evaporator 15 at low temperature is not completely brought into the gas state as described above, and has the form of the mixed phase flow of liquid/gas (damp state).

Here, when the ratio of the low-pressure portion volume in the internal heat exchanger 45 is set to 5% or more and 30% or less with respect to the volume of the whole low-pressure portion in the refrigerant circuit 110 as described above, the refrigerant on the low-pressure side of the internal heat exchanger 45 is brought into the complete gas state, and a superheating degree can be secured.

Accordingly, a disadvantage that the liquid refrigerant is sucked into the compressor 111 to break the compressor 111 can be avoided in advance.

It is to be noted that the refrigerant heated by the internal heat exchanger 45 repeats a cycle of being sucked into the compression element 130 of the compressor 11 from the refrigerant introducing tube 30.

As described above in detail, the refrigeration capability can be sufficiently secured also in the refrigerant cycle apparatus in which carbon dioxide is used as the refrigerant according to the present invention.

It is to be noted that in the above-described embodiments, the capillary tube 14 has been used as the pressure reducing device, but the present invention is not limited to this example, and an electric or mechanical expansion valve or the like may be used.

What is claimed is:

1. A transition critical refrigerant cycle apparatus constituted by connecting a compressor, a gas cooler, a pressure reducing device, an evaporator and the like in an annular shape, using carbon dioxide as a refrigerant, and capable of having a supercritical pressure on a high-pressure side, the apparatus comprising:

an internal heat exchanger for exchanging heat between a refrigerant which has flown out of the gas cooler and a refrigerant which has flown out of the evaporator; the internal heat exchanger having a double tube having inner and outer tubes, the high-pressure-side channel being disposed in the inner tube, and the low-pressure-side channel being disposed between the inner tube and the outer tube;

wherein the internal heat exchanger comprises a high-pressure-side channel through which the refrigerant from the gas cooler flows, and a low-pressure-side channel which is disposed in a heat exchanging manner with the high-pressure-side channel and through which the refrigerant from the evaporator flows, the refrigerant being passed upwards from below in the high-pressure-side channel, and the refrigerant being passed downwards from above in the low-pressure-side channel.

2. A transition critical refrigerant cycle apparatus constituted by connecting a compressor, a gas cooler, a pressure reducing device, an evaporator and the like in an annular shape, using carbon dioxide as a refrigerant, and capable of having a supercritical pressure on a high-pressure side, the apparatus comprising:

an internal heat exchanger for exchanging heat between a refrigerant which has flown out of the gas cooler and a refrigerant which has flown out of the evaporator; the internal heat exchanger having a stacked plate having two system channels therein, one channel being constituted as the high-pressure-side channel, and the other channel being constituted as the low-pressure-side channel;

wherein the internal heat exchanger comprises a high-pressure-side channel through which the refrigerant from the gas cooler flows, and a low-pressure-side channel which is disposed in a heat exchanging manner with the high-pressure-side channel and through which the refrigerant from the evaporator flows, the refrigerant being passed upwards from below in the high-pressure-side channel, and the refrigerant being passed downwards from above in the low-pressure-side channel.

3. A refrigerant cycle apparatus constituted by connecting a compressor, a gas cooler, a pressure reducing device, an evaporator and the like in an annular shape, using carbon dioxide as the refrigerant, and having a supercritical pressure on a high-pressure side, the apparatus comprising:

an internal heat exchanger for exchanging heat between a refrigerant which has flown out of the gas cooler and a refrigerant which has flown out of the evaporator, wherein a ratio of a low-pressure portion volume in a cycle is set to 30% or more and 50% or less of a total volume, and a ratio of the low-pressure portion volume in the internal heat exchanger is set to 5% or more and 30% or less with respect to a total volume of a whole low-pressure portion in the cycle.

4. The refrigerant cycle apparatus according to claim 3, wherein the compressor comprises first and second compression elements disposed in a sealed container, an intermediate-pressure refrigerant compressed by the first compression element and discharged into the sealed container is compressed and discharged by the second compression element, and a ratio of an intermediate-pressure portion volume in the cycle is set to 20% or more and 50% or less of a total volume.

5. The refrigerant cycle apparatus according to claim 4, further comprising:

an intermediate cooling circuit for cooling the intermediate-pressure refrigerant discharged into the sealed container from the first compression element, and thereafter allowing the second compression element to suck the refrigerant.

* * * * *